US006161462A

United States Patent [19]

Michaelson

[11] Patent Number: 6,161,462

[45] Date of Patent: Dec. 19, 2000

[54] BULLETPROOF BLANKET FOR USE WITH LAW ENFORCEMENT VEHICLES SUCH AS POLICE CARS

[76] Inventor: Eric Burton Michaelson, 18446 Hart St., Reseda, Calif. 91335-4215

[21] Appl. No.: 09/272,483

[22] Filed: Mar. 19, 1999

[51] Int. Cl.[7] ..... F41H 5/00

[52] U.S. Cl. ..... 89/36.01; 89/36.02; 89/36.04; 102/303

[58] Field of Search ..... 89/36.01, 36.04, 89/36.07, 36.08, 36.11, 36.12, 36.02; 102/303

[56] References Cited

U.S. PATENT DOCUMENTS

| | | | |
|---|---|---|---|
| 2,326,713 | 8/1943 | Wesseler | 89/36.02 |
| 3,491,847 | 1/1970 | Abbott | 89/36.05 |
| 3,793,953 | 2/1974 | Lewis | 102/303 |
| 3,801,416 | 4/1974 | Gulbierz | 109/49.5 |
| 4,245,546 | 1/1981 | Chaires | 89/36.09 |
| 4,412,495 | 11/1983 | Sankar | 109/49.5 |
| 4,782,735 | 11/1988 | Mui et al. | 89/36.07 |
| 4,834,947 | 5/1989 | Cook et al. | 422/117 |
| 4,836,079 | 6/1989 | Barrett | 86/50 |
| 5,377,577 | 1/1995 | Bounknong et al. | 89/36.05 |
| 5,524,694 | 6/1996 | Arapis | 160/370.21 |
| 5,531,500 | 7/1996 | Podvin | 296/152 |
| 5,756,922 | 5/1998 | Fuller | 89/36.02 |
| 5,824,940 | 10/1998 | Chediak et al. | 89/36.05 |

*Primary Examiner*—Peter M. Poon
*Assistant Examiner*—Judith A. Nelson

[57] ABSTRACT

A bulletproof blanket for use with law enforcement vehicles, including a plurality of envelopes containing panels. Each of the panels is fabricated of a lightweight material. Each of the envelopes containing panels has a short lower horizontal edge, an upper edge, and long vertical side edges therebetween. A plurality of flexible connector straps are vertically positioned between adjacent edges of the envelopes. Each of the straps has a first edge coupled to an envelope adjacent one edge and a second edge coupled to an adjacent envelope. In this manner the envelopes containing panels may be positioned in an essentially vertical plane when deployed for operation and use. The envelopes containing panels may also be positioned in a stacked parallel planar array, accordion style, for storage and transportation.

5 Claims, 3 Drawing Sheets

FIG 1
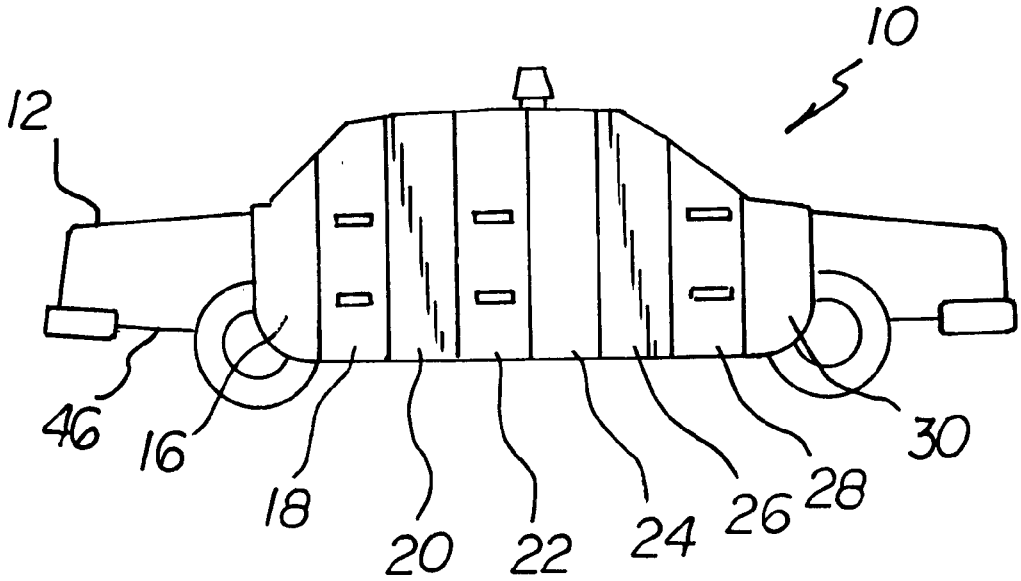
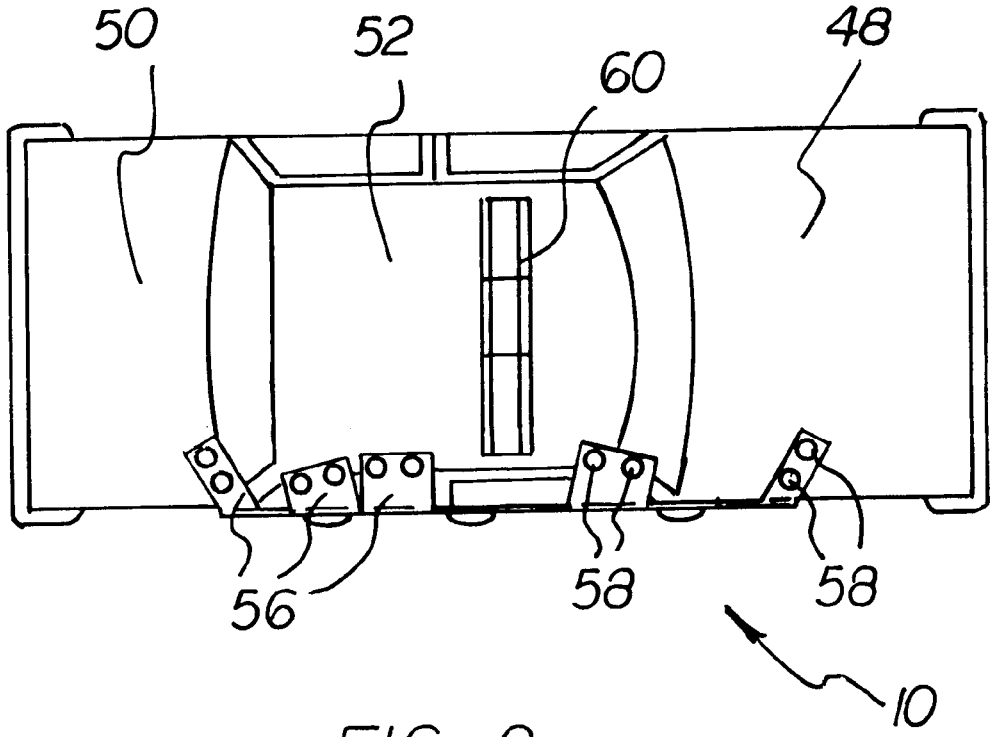
FIG 2

FIG 5
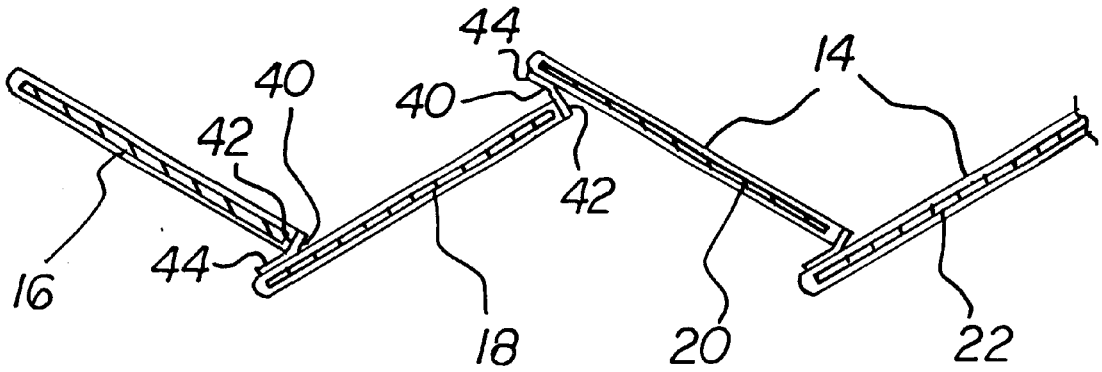
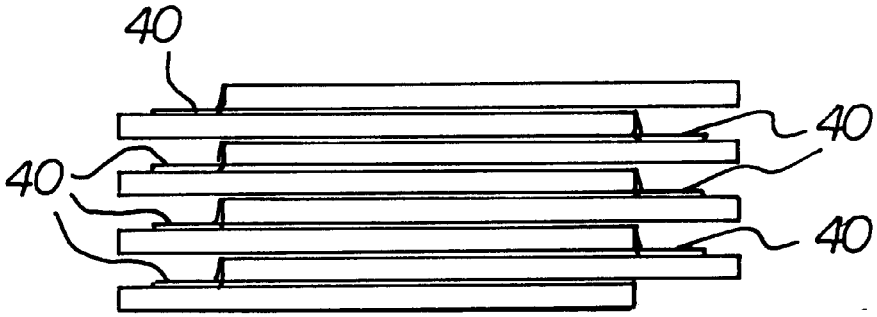
FIG 6

BULLETPROOF BLANKET FOR USE WITH LAW ENFORCEMENT VEHICLES SUCH AS POLICE CARS

BACKGROUND OF THE INVENTION

1. Field of the Invention

The present invention relates to a bulletproof blanket for use with law enforcement vehicles and more particularly pertains to protecting law enforcement personnel when effecting a rescue as during a shootout, a stand off, or a like perilous situation.

2. Description of the Prior Art

The use of bulletproof devices of known designs and configurations is known in the prior art. More specifically, bulletproof devices of known designs and configurations heretofore devised and utilized for the purpose of protecting law enforcement personnel through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,245,546 to Chaires discloses a portable bulletproof shield. U.S. Pat. No. 4,412,495 to Sankar discloses a total body protective shield. U.S. Pat. No. 4,782,735 to Mui, et al discloses a bulletproof protection apparatus. U.S. Pat. No. 4,843,947 to Bauer, et al discloses a riot shield. U.S. Pat. No. 5,377,577 to Bounkong, et al discloses a ballistic shield. U.S. Pat. No. 5,524,694 to Arapis discloses a protective screen for vehicle window. Lastly, U.S. Pat. No. 5,531,500 to Podvin discloses a bulletproofing panel.

While these devices fulfill their respective, particular objectives and requirements, the aforementioned patents do not describe a bulletproof blanket for use with law enforcement vehicles that allows protecting law enforcement personnel when effecting a rescue as during a shootout or the like.

In this respect, the bulletproof blanket for use with law enforcement vehicles according to the present invention substantially departs from the conventional concepts and designs of the prior art, and in doing so provides an apparatus primarily developed for the purpose of protecting law enforcement personnel when effecting a rescue as during a shootout, a standoff, or the like.

Therefore, it can be appreciated that there exists a continuing need for a new and improved bulletproof blanket for use with law enforcement vehicles, which can be used for protecting law enforcement personnel when effecting a rescue as during a shootout or the like. In this regard, the present invention substantially fulfills this need.

SUMMARY OF THE INVENTION

In view of the foregoing disadvantages inherent in the known types of bulletproof devices of known designs and configurations now present in the prior art, the present invention provides an improved bulletproof blanket for use with law enforcement vehicles. As such, the general purpose of the present invention, which will be described subsequently in greater detail, is to provide a new and improved bulletproof blanket for use with law enforcement vehicles such as police cars and method which has all the advantages of the prior art and none of the disadvantages.

To attain this, the present invention essentially comprises a bulletproof blanket for use with law enforcement vehicles.

Included are a plurality of panels. Each of the panels is fabricated of a lightweight bulletproof material positioned within a fabric formed of envelopes removably receiving the panels. Each of the panels and envelopes has a short lower horizontal edge, an upper edge, and long vertical side edges therebetween. Next provided is a plurality of flexible connector straps. The straps are vertically positioned between adjacent edges of envelopes. Each of the straps has a first edge coupled to an envelope adjacent one edge. A second edge of each strap is coupled to an adjacent envelope inboard of the adjacent edge. In this manner the envelopes and panels may be positioned in a generally vertical plane with overlapping side edges when deployed for operation and use for precluding dangerous gaps between panels. The envelopes and panels may also be positioned in a stacked parallel planar array, accordion style, for storage and transportation. During deployment, the lower edges of the envelopes and panels are positioned in a horizontal orientation adjacent to the bottom of a vehicle. During deployment, the lower edges of the envelopes and panels are positioned in a central extent of the bottom of the vehicle and extend upwardly therefrom. The upper edges of the panels terminate over the hood of the vehicle and the trunk of the vehicle. The upper edges are at a higher elevation adjacent to the center and tapering downwardly to a lower elevation adjacent to the end edges. In this manner, the end envelopes and panels are positioned at the top of a hood and trunk. The central envelopes and panels are positioned on the cab at the central extent of a vehicle when deployed for operation and use. The end envelopes and panels and at least some of the central panels have a generally upwardly extending rectangular extension. Next provided for each are a pair of laterally placed magnets. The magnets are provided for releasable securement to the vehicle at upper generally horizontal regions thereof. The upper edge of some of the envelopes are free of extensions for allowing positioning of the system around lights on the top of the vehicle. Next provided is a pair of vertically disposed straps. The straps are on at least some of the envelopes facing outwardly thereof. The straps are provided for use as handles for using the blanket as a shield independent of the vehicle and for movement of the system between the deployed and stored orientations and for transportation of the blanket.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bulletproof blanket for use with law enforcement vehicles, which has all of the advantages of the prior art bulletproof devices of known designs and configurations and none of the disadvantages.

It is another object of the present invention to provide a new and improved bulletproof blanket for use with law enforcement vehicles which may be easily and efficiently manufactured and marketed.

It is a further object of the present invention to provide a new and improved bulletproof blanket for use with law enforcement vehicles which is of durable and reliable constructions.

An even further object of the present invention is to provide a new and improved bulletproof blanket for use with law enforcement vehicles, which is susceptible of a low cost of manufacture with regard to both materials and labor, and which accordingly is then susceptible of low prices of sale to the consuming public, thereby making such bulletproof blanket for use with law enforcement vehicles economically available to the buying public.

Even still another object of the present invention is to provide a bulletproof blanket for use by law enforcement personnel on vehicles, for protection when effecting a rescue as during a shootout, a standoff, or like perilous situations.

Lastly, it is an object of the present invention to provide a new and improved bulletproof blanket for use with law enforcement vehicles, including a plurality of panels located within fabric envelopes. Each of the panels is fabricated of a lightweight material. Each of the envelopes and panels has a short lower horizontal edge, an upper edge, and long vertical side edges therebetween. A plurality of flexible connector straps is vertically positioned between adjacent edges of envelopes. Each of the straps has a first edge coupled to a panel adjacent one edge and a second edge coupled to an adjacent envelope. In this manner the envelopes and panels may be positioned in an essentially vertical plane when deployed for operation and use. The envelopes and panels may also be positioned in a stacked parallel planar array, accordion style, for storage and transportation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of the new and improved bulletproof blanket system constructed in accordance with the principles of the present invention.

FIG. 2 is a top elevational view of the system shown in FIG. 1.

FIG. 5 is a cross-sectional view taken along line 5—5 of FIG. 3.

FIG. 6 is a top elevational view of the blanket shown in the prior figures, but in a fully folded orientation.

The same reference numerals refer to the same parts through the various Figures.

DESCRIPTION OF THE PREFERRED EMBODIMENT

Figure 3:
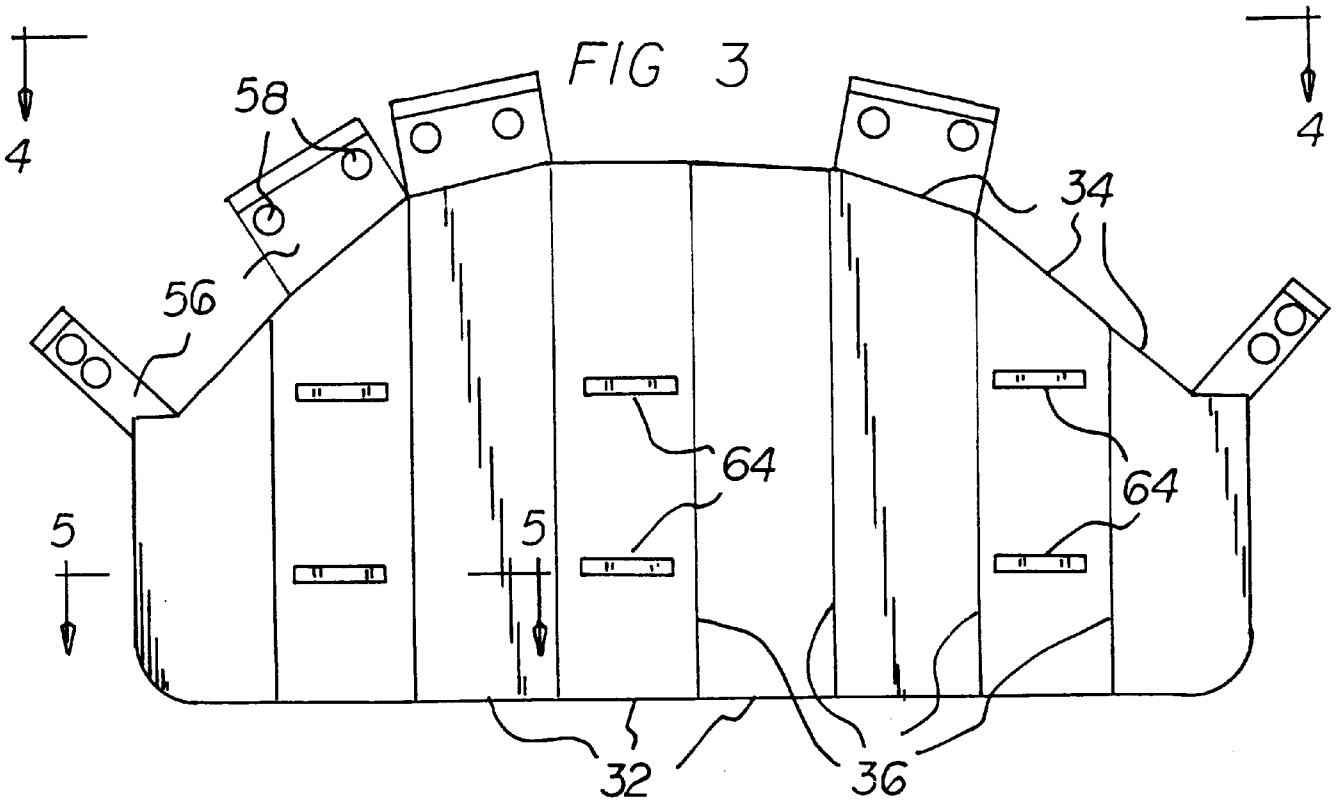
FIG. 3 is a side elevational view of the blanket shown in the prior figures but not mounted on a vehicle.
Figure 4:
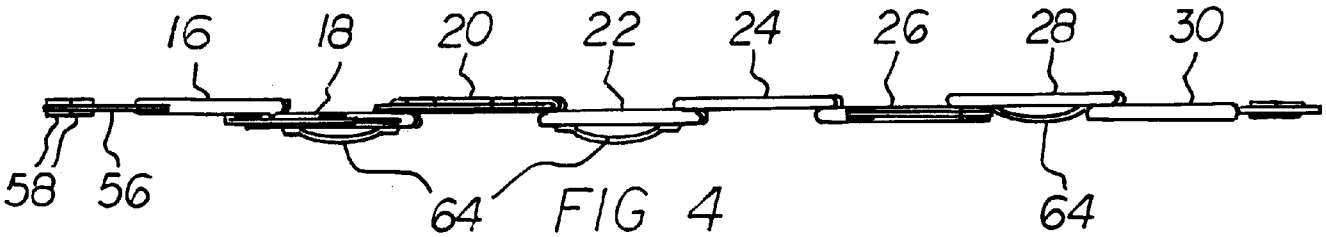
FIG. 4 is a top plan view of the device taken along line 4—4 of FIG. 3.

With reference now to the drawings, and in particular to FIG. 1 thereof, the preferred embodiment of the new and improved bulletproof blanket for use with law enforcement vehicles embodying the principles and concepts of the present invention and generally designated by the reference numeral 10 will be described.

The present invention, the bulletproof blanket for use with a law enforcement vehicle 10 is comprised of a plurality of components. Such components in their broadest context include a plurality of envelopes and panels and a plurality of flexible connector straps. Such components are individually configured and correlated with respect to each other so as to attain the desired objective.

The new and improved bulletproof blanket system 10 for use with law enforcement vehicles 12 includes a plurality of envelopes 14 removably containing panels 16, 18, 20, 22, 24, 26, 28, 30. Each of the panels is fabricated of a lightweight bulletproof material selected from the class of bulletproof materials including Armacel Armor™ which is a combination of synthetic fibers set, under tension, in a secret formula of resins. The specific number and type of fibers and the formulation of the resins is protected by trade secret. Armacel Armor™ is currently sold by Armacel Body Armor Corporation of Camarillo, Calif. An alternate bulletproof material for the panels is an armamide fiber sold under the registered trademark Kevlar® by E. I. DuPont de Nemours of Wilmington, Del. Further acceptable materials for the bulletproof panels are very high molecular weight polyolefins as described, for example, in U.S. Pat. No. 5,536,553 and a high strength fiber with a ceramic material as described, for example, in U.S. Pat. No. 5,824,940. The subject matter of such patents is incorporated herein by reference. Each of the panels has a short lower horizontal edge 32, an upper edge 34, and long vertical side edges 36 therebetween.

Next provided is a plurality of flexible connector straps 40. The straps are vertically positioned between adjacent edges of the envelope sections. Each of the straps has a first edge 42 coupled to an envelope section adjacent one edge. A second edge 44 of each strap is coupled to an adjacent envelope section inboard of the adjacent edge. In this manner the envelopes and panels may be positioned in an essentially vertical plane when deployed for operation and use. The envelopes and panels may also be positioned in a stacked parallel planar array, accordion style, for storage and transportation.

The bulletproof panels are preferably independent of the fabric envelopes which when taken together constitute a carrier for the panels. The sections of the carrier each have an opening at the top or, in the alternative, or the vertical side edges for removably receiving the panels.

The lower edges 32 of the envelopes and panels during deployment are positioned in a horizontal orientation adjacent to the bottom 46 of a vehicle 12. During deployment, the lower edges of the envelopes and panels are positioned in a central extent of the bottom of the vehicle and extend upwardly therefrom. The upper edges of the envelopes and panels terminate over the hood 48 of the vehicle and the trunk 50 of the vehicle. The upper edges are at a higher elevation adjacent to the center and tapering downwardly to a lower elevation adjacent to the end edges. In this manner, the end envelopes and panels are positioned adjacent to the top of a hood 48 and trunk 50. The central envelopes containing panels are positioned on the cab 52 at the central extent of a vehicle when deployed for operation and use.

The end envelopes containing panels and at least some of the central envelopes have a generally upwardly extending rectangular extension 56. Next provided for each are a pair of laterally placed magnets 58. The magnets are provided for releasable securement to the vehicle at upper generally horizontal regions thereof. The upper edge of some of the panels is free of extensions for allowing positioning of the system around lights 60 on the top of the vehicle.

Next provided is a pair of vertically disposed straps 64. The straps are on at least some of the envelopes facing outwardly thereof. The straps are provided for use when the blanket is to be employed as a shell for personnel independent of the vehicle. The panels provide sufficient rigidity for such purpose. In the alternative, the handles may also be employed for movement of the system between the deployed and stored orientations and for transportation of the blanket.

The general purpose of the present invention blanket is to provide law enforcement personnel with a field deployed protection behind which they may effect a rescue of wounded or trapped officers or civilians. It can also be used to more safely gain a tactical advantage over a suspect.

To the best of our knowledge, no item of this nature exists on the market. There are bomb blankets for containing shrapnel from explosives. There are mats for police snipers to lie on to protect them from being shot from below. Officers may hang bulletproof vests over the car doors in order to enter a situation. This is precisely the situation where the bulletproof blanket will be deployed.

Both the bomb blanket and the sniper material contain Kevlar® as their primary ballistic material. Kevlar® is too heavy for this application when constructed to the N.I.J. IIIA Level. These two items are, therefore, only offered in a smaller size and a lesser threat protection level. ARMACEL ARMOR CORP™, has developed a vehicle armor. This armor, however, will be installed in the front door panels of police vehicles. Although it meets a Level IV, it will only offer protection for the officer who squats down behind the door, such as in a felony stop situation. It offers no protection for the windows or the rear passenger compartment.

The present invention is not installed in any one vehicle. It can be transferred as easily as a weapon, a radio, or any other piece of equipment. It protects the entire side of the vehicle. It can be deployed on a car in seconds by one officer. It can be carried by handholds by two to four officers to act as a mobile shield. It folds up to a dimension of 54"L× 18"W×5"H. It stores easily in the trunk of any vehicle.

An officer comes upon a scene where a suspect has already wounded a civilian. The wounded individual is directly in the line of fire. The suspect holds off any rescue attempt by continued fire. The officer, out of the line of fire, exits his vehicle and removes the present invention from the trunk and closes the trunk lid. He lays the magnet of the first panel on the trunk lid where it attaches immediately. The blanket unfolds in an accordion fashion and each magnet attaches upon contact to the vehicle. The officer then reenters the vehicle and drives directly into the line of fire to effect the rescue. He drives his vehicle between the suspect and the victim. Using the present invention, and the vehicle, as a shield, the officer can assist the victim into the back seat on the driver's side. He then drives the vehicle and the victim to safety. The blanket can be deployed on either the passenger side or the driver's side of the vehicle. Two additional panels, for the windshield and rear window, may be used in conjunction with the bulletproof blanket.

The concept of a field deployed, armored blanket to protect a vehicle is new. It is believed that the use of magnets as a method of attachment is new. It is believed that the accordion style of folding is new. It is now believed that the use of Armacel Armor™ ballistic panels for this use is new.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved bulletproof blanket system for use with law enforcement vehicles for protection of law enforcement personnel when effecting a rescue as during a shootout or the like comprising, in combination:

a plurality of envelopes containing panels, and each of the panels being fabricated of a lightweight bulletproof material selected from the class of bulletproof materials including Armacel Armor™, Kevlar®, very high molecular weight polyolefins and a high strength fiber with ceramic material, preferably Armacel®, each of the envelopes containing panels having a short lower horizontal edge, an upper edge, and long vertical side edges therebetween;

a plurality of flexible connector straps vertically positioned between adjacent edges of envelopes, each of the straps having a first edge coupled to an envelopes adjacent one edge and a second edge coupled to an adjacent envelope inboard of the adjacent edge whereby the envelopes and panels may be positioned in a generally vertical plane with slight overlap when deployed for operation and use and may also be positioned in a stacked parallel planar array accordion style for storage and transportation;

the lower edges during deployment being positioned in a horizontal orientation adjacent to the bottom of a vehicle in a central extent thereof and extending upwardly therefrom with their upper edges terminating over the hood of the vehicle and the trunk of the vehicle and with the upper edges being at a higher elevation adjacent to the center and tapering downwardly to a lower elevation adjacent to the end edges for positioning of the end envelopes containing panels on top of a hood and trunk, and the central envelopes containing panels on the cab at the central extent of a vehicle when deployed for operation and use, the end envelopes containing panels and at least some of the central envelopes containing panels having a generally upwardly extending rectangular extension, each with a pair of laterally placed magnets for releasable securement to the vehicle at upper generally horizontal regions thereof, the upper edge of some of the envelopes containing panels being free of extensions for allowing positioning of the system around lights on the top of the vehicle; and a pair of vertically disposed straps on at least some of the envelopes facing outwardly thereof for use as handles when using the blanket as a shield and for movement of the system between the deployed and stored orientations and for transportation thereof.

2. A bulletproof blanket comprising:

a plurality of envelopes and panels each of the panels being fabricated of a lightweight material, each of the envelopes and panels having a short lower horizontal edge, an upper edge, and long vertical side edges therebetween; and a plurality of flexible connector straps vertically positioned between adjacent edges of envelopes, each of the straps having a first edge coupled to an envelope adjacent one edge and a second edge coupled to an adjacent envelope whereby the envelopes and panels may be positioned in an essentially vertical plane when deployed for operation and use and may also be positioned in a stacked parallel planar array accordion style for storage and transportation.

3. The bullet proof blanket as set forth in claim 2;

wherein the lower edges during deployment are positioned in a horizontal orientation adjacent to the bottom of a vehicle in a central extent thereof and extending upwardly therefrom with their upper edges terminating over the hood of the vehicle and the trunk of the vehicle and with the upper edges being at a higher elevation adjacent to the center and tapering downwardly to a lower elevation adjacent to the end edges for positioning of the end envelopes containing panels on top of a hood and trunk, and the central envelopes containing panels on the cab at the central extent of a vehicle when deployed for operation and use, the end panels.

4. The bulletproof blanket as set forth in claim 3;

wherein at least some of the central envelopes containing panels have a generally upwardly extending rectangular extension, each with a pair of laterally placed magnets for releasable securement to the vehicle at upper generally horizontal regions thereof, the upper edge of some of the envelopes being free of extensions for allowing positioning of the system around lights on the top of the vehicle.

5. The bulletproof blanket as set forth in claim 2 and further including a pair of vertically disposed straps on at least some of the panels facing outwardly thereof for use as handles in movement of the system between the deployed and stored orientations and for transportation thereof.

* * * * *